US010338507B2

(12) United States Patent
Yamaki et al.

(10) Patent No.: US 10,338,507 B2
(45) Date of Patent: Jul. 2, 2019

(54) IMAGE FORMING APPARATUS CAPABLE OF ESTIMATING LIFE OF ION CONDUCTIVE COMPONENT AND METHOD FOR ESTIMATING LIFE OF ION CONDUCTIVE COMPONENT

(71) Applicant: KONICA MINOLTA, INC., Chiyoda-ku, Tokyo (JP)

(72) Inventors: Hideo Yamaki, Hachioji (JP); Satoru Shibuya, Chiryu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/793,395

(22) Filed: Oct. 25, 2017

(65) Prior Publication Data

US 2018/0120744 A1 May 3, 2018

(30) Foreign Application Priority Data

Oct. 31, 2016 (JP) ..... 2016-213103

(51) Int. Cl.

| | |
|---|---|
| ***G03G 15/00*** | (2006.01) |
| ***G03G 15/20*** | (2006.01) |
| ***G03G 15/01*** | (2006.01) |
| ***G03G 21/06*** | (2006.01) |
| *G03G 15/16* | (2006.01) |

(52) U.S. Cl.

CPC ..... *G03G 15/2053* (2013.01); *G03G 15/0142* (2013.01); *G03G 15/553* (2013.01); *G03G 21/06* (2013.01); *G03G 15/1605* (2013.01); *G03G 15/1685* (2013.01)

(58) Field of Classification Search

CPC .. G03G 15/553; G03G 15/55; G03G 21/1889; G03G 15/75; G03G 2221/1663

USPC ..... 399/26

See application file for complete search history.

(56) References Cited

U.S. PATENT DOCUMENTS

2008/0247778 A1* 10/2008 Motokawa ..... C08G 18/10 399/159
2010/0250149 A1* 9/2010 Omori ..... G01R 31/2849 702/34
2011/0309918 A1* 12/2011 Ramsay ..... G08B 6/00 340/407.1
2015/0382391 A1* 12/2015 Hamachi ..... H04W 76/14 370/329

FOREIGN PATENT DOCUMENTS

JP 2004009435 A 1/2004

OTHER PUBLICATIONS

Translation of Hayashi (JP 2004-009435) listed in the IDS, publication date: Jan. 15, 2004.*

* cited by examiner

*Primary Examiner* — Walter L Lindsay, Jr.
*Assistant Examiner* — Frederick Wenderoth
(74) *Attorney, Agent, or Firm* — Holtz, Holtz & Volek PC

(57) ABSTRACT

Provided is an image forming apparatus capable of estimating lives of components more accurately than before. The image forming apparatus includes an ion conductive component, and a processor for estimating a life of the conductive component. The processor acquires an index value related to energization of the conductive component, and estimates the life of the conductive component based on the index value per unit time.

18 Claims, 18 Drawing Sheets

FIG.4

372

| COMPONENT | NUMBER OF PRINTED SHEETS (K SHEETS) | REPLACEMENT TIMING |
|---|---|---|
| CHARGING ROLLER 4Y | 300 | 201605241201 |
| ··· | ··· | |
| PRIMARY TRANSFER ROLLER 7Y | 300 | 201605241201 |
| ··· | ··· | |
| INTERMEDIATE TRANSFER ROLLER 1 | 500 | 201608050915 |
| SECONDARY TRANSFER ROLLER 9 | 400 | 201607111420 |

FIG.15

1500

| TRANSPORT SPEED[mm/sec] | COEFFICIENT |
|---|---|
| $v < 300$ | 0.5 |
| $300 \leq v < 400$ | 1.0 |
| $400 \leq v$ | 2.0 |

FIG.16

1600

| TYPE OF SHEETS | COEFFICIENT |
|---|---|
| THICK PAPER | 2.0 |
| PLAIN PAPER | 1.0 |
| THIN PAPER | 0.5 |

FIG.17

1700

| TYPE OF PRINTING | COEFFICIENT |
|---|---|
| SINGLE-SIDED PRINTING | 1.0 |
| DOUBLE-SIDED PRINTIN | 1.5 |

IMAGE FORMING APPARATUS CAPABLE OF ESTIMATING LIFE OF ION CONDUCTIVE COMPONENT AND METHOD FOR ESTIMATING LIFE OF ION CONDUCTIVE COMPONENT

Japanese Patent Application No. 2016-213103 filed on Oct. 31, 2016, including description, claims, drawings, and abstract the entire disclosure is incorporated herein by reference in its entirety.

BACKGROUND

Technological Field

The present disclosure relates to an image forming apparatus, and more particularly to an image forming apparatus having an ion conductive component.

Description of the Related Art

In recent years, products have been required to be environmentally friendly. As an example thereof, components constituting a product are required to have longer lives, and the accuracy of estimating replacement timing of these components is required to be improved. Such a technique is also strongly required for image forming apparatuses.

Regarding techniques of estimating lives of components of an image forming apparatus, Japanese Laid-Open Patent Publication No. 2004-009435 discloses a technique of estimating lives of components constituting a printing apparatus based on a cumulative operation time of each component.

However, in the printing apparatus disclosed in Japanese Laid-Open Patent Publication No. 2004-009435, there is a certain gap between the estimated life and the actual life of each component, and thus there have been some cases where replacement of a component is urged, although the component is actually still usable.

The present disclosure has been made to solve the aforementioned problem, and an object of the present disclosure in an aspect is to provide an image forming apparatus capable of estimating lives of components more accurately than before. An object of the present disclosure in another aspect is to provide a life estimation method capable of estimating lives of components more accurately than before.

SUMMARY

To achieve at least one of the abovementioned objects, according to an aspect of the present invention, an image forming apparatus reflecting one aspect of the present invention comprises an ion conductive component, and a processor for estimating a life of the conductive component. The processor acquires an index value related to energization of the conductive component, and estimates the life of the conductive component based on the index value per unit time.

Preferably, the conductive component includes at least one of a charging roller for charging an image carrier configured to be able to carry a toner image, an intermediate transfer roller for receiving the toner image formed on the image carrier and transporting the toner image, a primary transfer roller for transferring the toner image formed on the image carrier to the intermediate transfer roller, and a secondary transfer roller for transferring the toner image formed on the intermediate transfer roller to a recording medium.

Preferably, the index value includes at least one of a number of printed sheets, a voltage application time for which a voltage is applied to the conductive component, a voltage application distance for which the voltage is applied to the conductive component, a running time of the conductive component, and a running distance of the conductive component.

Preferably, the processor is configured to estimate that the conductive component has a short life when the index value per unit time is high, and to estimate that the conductive component has a long life when the index value per unit time is low.

Preferably, the index value includes a non-operating time of the conductive component.

More preferably, the processor is configured to estimate that the conductive component has a short life when the index value per unit time is low, and to estimate that the conductive component has a long life when the index value per unit time is high.

Preferably, the image forming apparatus further comprises a sensor for acquiring an electrical characteristic value of the conductive component. The processor is configured to correct the estimated life of the conductive component based on the electrical characteristic value acquired by the sensor.

Preferably, the image forming apparatus further comprises a communication interface for communicating with an external apparatus. The processor is configured to transmit the estimated life to the external apparatus via the communication interface.

More preferably, the processor is configured to calculate a time that elapses until the life of the conductive component ends, based on the index value per unit time.

Preferably, the image forming apparatus further comprises a display. The processor is configured to display the estimated life on the display.

Preferably, the processor is configured to estimate the life of the conductive component based on the index value per unit time and a coefficient corresponding to a material constituting the conductive component.

Preferably, the image forming apparatus further comprises an environment sensor for acquiring at least one of temperature and humidity. The processor is configured to correct the index value to be counted up in accordance with a value acquired by the environment sensor.

Preferably, the processor is configured to correct the index value based on a magnitude of a voltage applied to the conductive component.

Preferably, the processor is configured to correct the index value to be counted up in accordance with a transport speed of a recording medium.

Preferably, the image forming apparatus is configured to be able to perform double-sided printing on the recording medium. The conductive component is the secondary transfer roller. The processor is configured to correct the index value to be counted up by the double-sided printing on the recording medium.

Preferably, the conductive component is the secondary transfer roller. The processor is configured to correct the index value to be counted up in accordance with a type of the recording medium.

An image forming apparatus reflecting another aspect of the present invention comprises an ion conductive component, and a processor for estimating a life of the conductive component. The processor estimates the life of the conductive component based on an operating time and a non-operating time of the conductive component.

A method for estimating a life of an ion conductive component reflecting still another aspect of the present invention comprises acquiring an index value related to energization of the conductive component, and estimating the life of the conductive component based on the index value per unit time.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 4 is a view illustrating a table 372 for the number of printed sheets according to an embodiment.

FIG. 15 is a view illustrating a speed table 1500 according to an embodiment.

FIG. 16 is a view illustrating a sheet type table 1600 according to an embodiment.

FIG. 17 is a view illustrating a printing type table 1700 according to an embodiment.

DETAILED DESCRIPTION OF EMBODIMENTS

Hereinafter, one or more embodiments of the present invention will be described with reference to the drawings. However, the scope of the invention is not limited to the disclosed embodiments.

[Technical Idea]

An electrophotographic image forming apparatus may have conductive components such as a charging roller, a primary transfer roller, and a secondary transfer roller. Some of these conductive components are made of an ion conductive material in which charge carriers are ions. It is known that the resistance of an ion conductive material gradually increases during use (i.e., voltage application) due to non-uniform ion distribution therein.

Utilizing the above property, the image forming apparatus according to the related art estimates a time period that elapses until an operating time of a conductive component made of an ion conductive material (hereinafter also referred to as an "ion conductive component") reaches a predetermined value, as the life of the component. More specifically, the image forming apparatus according to the related art calculates a time period that elapses until the resistance value of the ion conductive material is estimated to reach a predetermined value, as the life of the ion conductive component. In an aspect, the "operating time" includes a time for which a voltage is applied to an ion conductive component, a time for which the component is driven, a printing time for which printing is performed using the component (print job execution time), and the like.

However, the applicant of the present application has found that non-uniformity of ion distribution (that is, increase in resistance) in an ion conductive material is gradually relieved in a time period for which no voltage is applied thereto.

Figure 1:
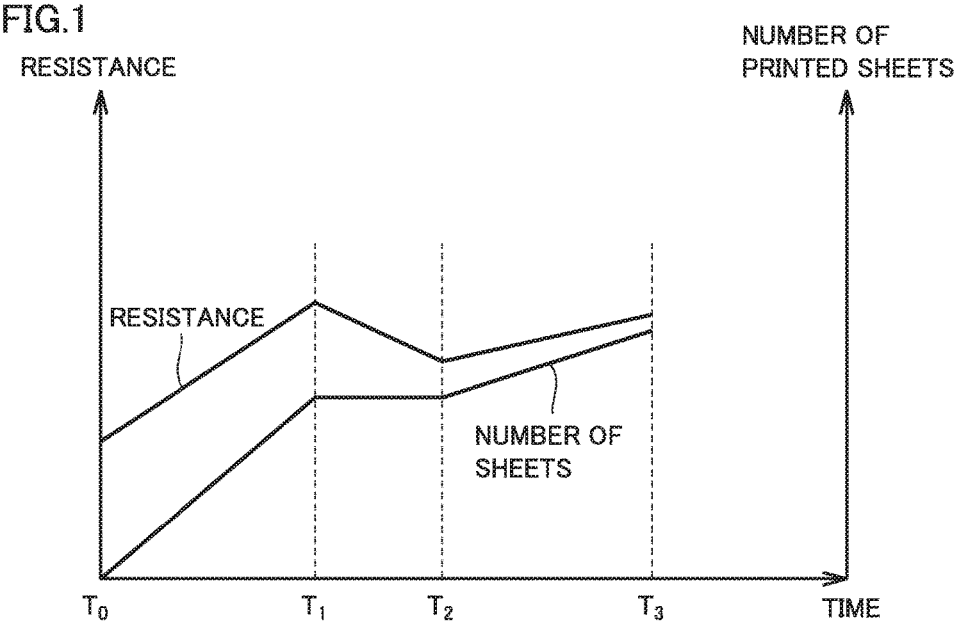
FIG. 1 is a view schematically illustrating a life estimation method according to an embodiment.

FIG. 1 is a view schematically illustrating a life estimation method according to an embodiment. In FIG. 1, the axis of abscissas represents time, the axis of ordinates on the left side represents the resistance of an ion conductive material, and the axis of ordinates on the right side represents the number of printed sheets. In FIG. 1, from a time point T0 to a time point T1, as the number of printed sheets increases, the resistance value of the ion conductive material also increases. This is because, as printing is performed, an electric field is generated in the ion conductive material and ion distribution becomes non-uniform.

From time point T1 to a time point T2, in a time period for which printing is stopped, in other words, in a time period for which no voltage is applied to the ion conductive material, the resistance value of the ion conductive material decreases. From time point T2 to a time point T3, when printing is started again, it can be seen that the resistance value of the ion conductive material also starts increasing.

As shown in FIG. 1, the resistance value of the ion conductive material does not increase monotonically as time elapses. Accordingly, when the life of an ion conductive component is estimated only based on the operating time of the component as in the image forming apparatus according to the related art, the estimated life will be shorter than the actual life. Thereby, a user of the image forming apparatus according to the related art is required to replace the ion conductive component in a shorter cycle, and thus the user may bear a larger economic burden.

In order to solve the aforementioned problem, an image forming apparatus according to an embodiment estimates the life of an ion conductive component, considering not only an operating time for which the component is operating, but also a non-operating time for which the component is not operating. Thereby, this image forming apparatus can estimate the life of the ion conductive component more accurately than the image forming apparatus according to the related art. A specific configuration and control of this image forming apparatus will be described below.

First Embodiment (Image Forming Apparatus 200)

Figure 2:
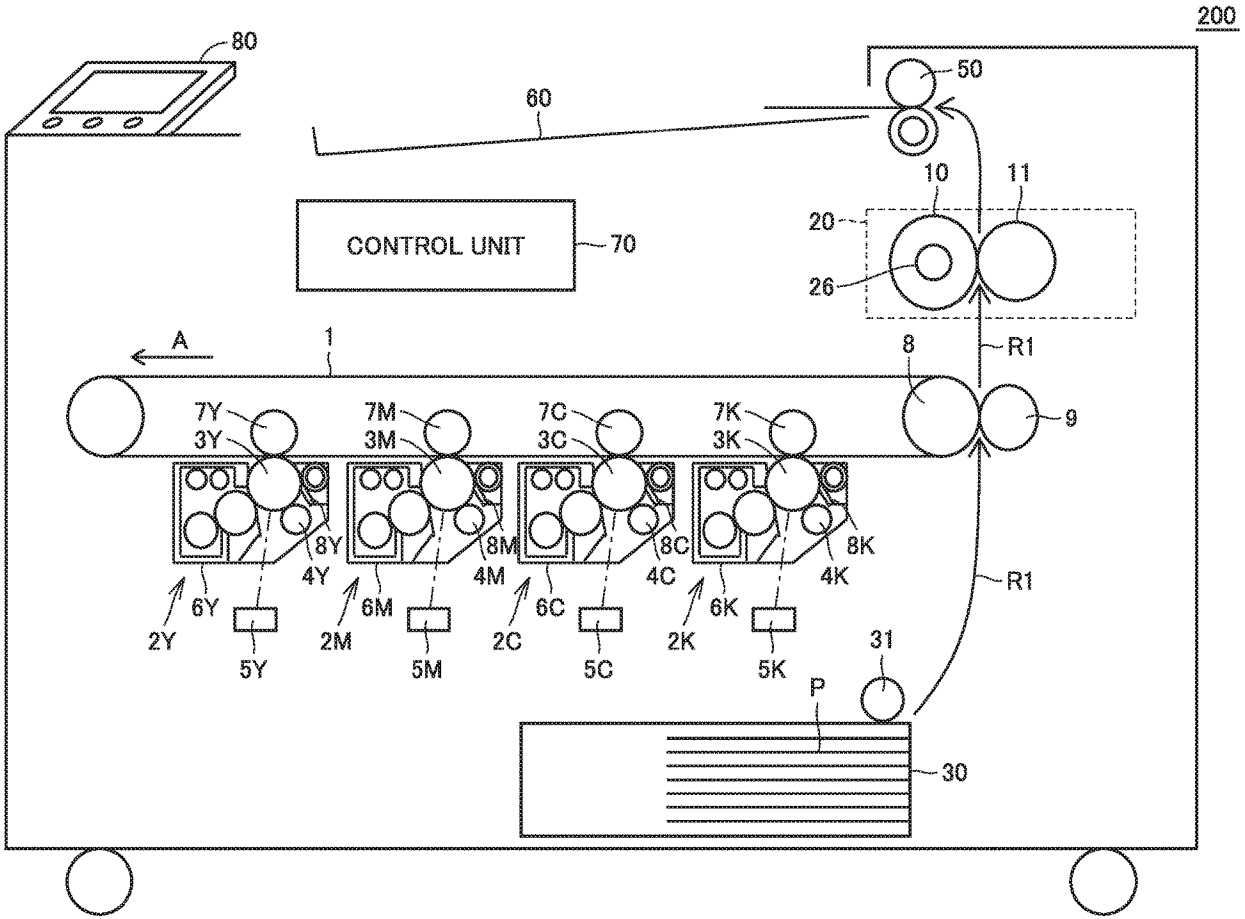
FIG. 2 is a view illustrating an exemplary configuration of an image forming apparatus 200 according to the embodiment.

FIG. 2 is a view illustrating an exemplary configuration of an image forming apparatus 200 according to an embodiment. In an embodiment, image forming apparatus 200 is an electrophotographic image forming apparatus such as a laser printer, an LED printer, or the like. As shown in FIG. 2, image forming apparatus 200 includes an intermediate transfer roller 1 as a belt component at a substantially central portion therein. Below the lower horizontal portion of intermediate transfer roller 1, four image forming units 2Y, 2M, 2C, and 2K corresponding to colors of yellow (Y), magenta (M), cyan (C), and black (K), respectively, are arranged side by side along intermediate transfer roller 1. These image forming units 2Y, 2M, 2C, and 2K have photoconductors 3Y, 3M, 3C, and 3K, respectively, configured to be able to carry toner images.

Charging rollers 4Y, 4M, 4C, and 4K for charging the corresponding photoconductors; print head units 5Y, 5M, 5C, and 5K; developing units 6Y, 6M, 6C, and 6K; and primary transfer rollers 7Y, 7M, 7C, and 7K are sequentially arranged around photoconductors 3Y, 3M. 3C, and 3K serving as image carriers, respectively, along the rotation direction of the respective photoconductors. Primary transfer rollers 7Y, 7M, 7C, and 7K are arranged to face photoconductors 3Y, 3M, 3C, and 3K, respectively, with intermediate transfer roller 1 sandwiched therebetween.

A secondary transfer roller 9 is pressed to contact a portion of intermediate transfer roller 1 that is supported by an intermediate transfer belt driving roller 8. In a region of this portion, secondary transfer is carried out. At a position downstream of a transport path R1 in the rear of the secondary transfer region, a fixing/heating unit 20 including a fixing roller 10 and a pressure roller 11 is arranged.

A sheet feeding cassette 30 is arranged in a lower portion of image forming apparatus 200 in an attachable/detachable manner. Sheets P loaded and housed within sheet feeding cassette 30 are to be fed one by one from the topmost sheet into transport path R1 by the rotation of a sheet feeding roller 31.

Further, an operation panel 80 is arranged in an upper portion of image forming apparatus 200. As an example, operation panel 80 includes a screen in which a touch panel and a display are layered on each other, and physical buttons.

In an aspect, intermediate transfer roller 1, charging rollers 4Y, 4M, 4C, and 4K, primary transfer rollers 7Y, 7M, 7C, and 7K, and secondary transfer roller 9 may function as ion conductive components. As an example, these conductive components may each include at least one ion conductive rubber such as hydrin rubber, acrylonitrile-butadiene nibber, epichlorohydrine nibber, and the like. Each of these conductive components may include an appropriate ion conductive material, depending on the required characteristic.

While image forming apparatus 200 in the above example adopts a tandem intermediate transfer system, the image forming apparatus is not limited thereto. Specifically, the image forming apparatus may be any image forming apparatus including an ion conductive component, and may be an image forming apparatus which adopts a cycle system, or an image forming apparatus which adopts a direct transfer system by which toner is directly transferred from a developing device to a printing medium.

(Schematic Operation of Image Forming Apparatus 200)

Next, a schematic operation of image forming apparatus 200 configured as described above will be described. When an image signal is input from an external apparatus (such as a personal computer, for example) to a control unit 70 of image forming apparatus 200, control unit 70 generates digital image signals by color conversion of the image signal into yellow, magenta, cyan, and black. Based on the input digital signals, control unit 70 causes print head units 5Y, 5M, 5C, and 5K of image forming units 2Y, 2M, 2C, and 2K to emit light so as to perform exposure.

Accordingly, electrostatic latent images formed on photoconductors 3Y, 3M, 3C, and 3K are developed by developing units 6Y, 6M, 6C, and 6K, respectively, to generate toner images in the respective colors. The toner images in the respective colors are successively superimposed on one another on intermediate transfer roller 1 moving in a direction indicated by an arrow A in FIG. 2, by the action of primary transfer rollers 7Y, 7M, 7C, and 7K. Primary transfer is thus accomplished.

The toner images thus formed on intermediate transfer roller 1 undergo secondary transfer all together onto a sheet P by the action of secondary transfer roller 9.

The toner image which is secondarily-transferred to sheet P reaches fixing/heating unit 20. The toner image is fixed on sheet P by the action of heated fixing roller 10 and pressure roller 11. Sheet P on which the toner image is fixed is ejected via a sheet ejection roller 50 to a sheet ejection tray 60.

(Control Unit 70)

Figure 3:
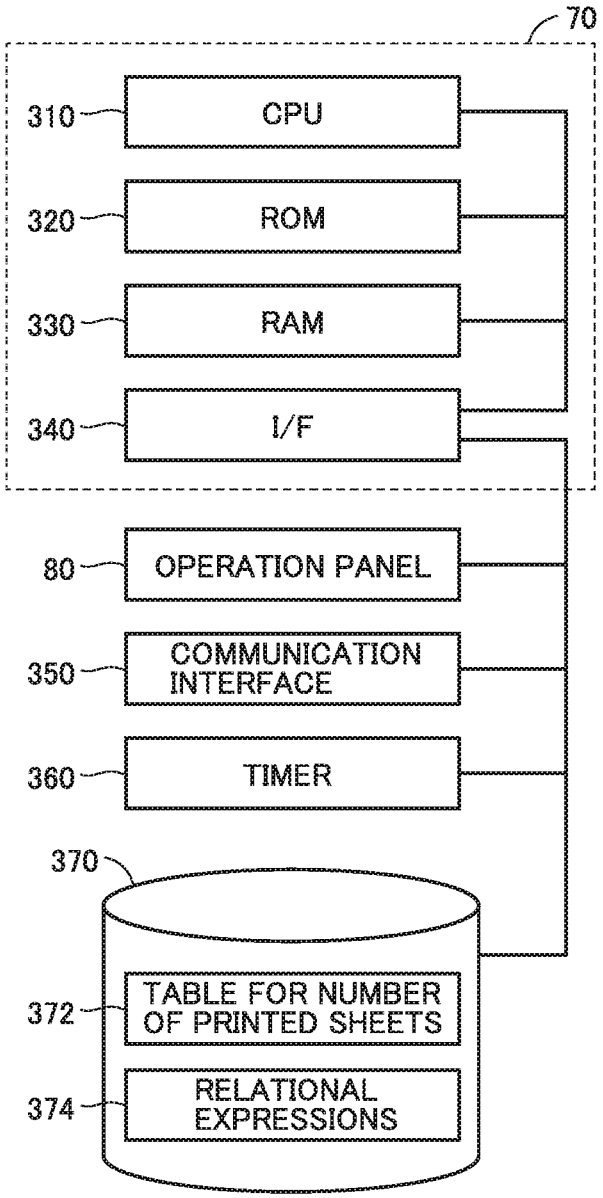
FIG. 3 is a view illustrating a control unit 70 according to an embodiment.

FIG. 3 is a view illustrating control unit 70 according to an embodiment. Control unit 70 includes, as its main control elements, a CPU (Central Processing Unit) 310, a RAM (Random Access Memory) 320, a ROM (Read Only Memory) 330, and an interface (I/F) 340.

CPU 310 reads a control program stored in ROM 330 or a storage device 370 described later, and executes the program to thereby control operation of image forming apparatus 200.

RAM 320 is typically a DRAM (Dynamic Random Access Memory) or the like, and can temporarily store image data and data necessary for CPU 310 to execute a program. Thus, RAM 320 can function as a so-called working memory.

ROM 330 is typically a flash memory or the like, and can store a program to be executed by CPU 310 and information about various settings for the operation of image forming apparatus 200.

CPU 310 is electrically connected to each of operation panel 80, a communication interface 350, a timer 360, and storage device 370, via interface 340, to exchange signals with various devices.

It is assumed that communication interface 350 is a wireless LAN (Local Area Network) card, as an example. Image forming apparatus 200 is configured to be able to communicate with an external apparatus (such as a personal computer, a smartphone, a tablet, or the like) connected to a LAN or a WAN (Wide Area Network) via communication interface 350.

Timer 360 counts time. As an example, timer 360 is constituted by a crystal oscillator.

Storage device 370 is typically constituted by a hard disk drive. Storage device 370 is configured to be able to hold a table 372 for the number of printed sheets, and relational expressions 374.

FIG. 4 is a view illustrating table 372 for the number of printed sheets according to an embodiment. Referring to FIG. 4, table 372 for the number of printed sheets holds each "component", the "number of printed sheets", and "replacement timing" in a manner in which they are associated with one another. In an aspect, table 372 for the number of printed sheets holds the number of printed sheets and the replacement timing for each of charging rollers 4Y, 4M, 4C, and 4K, primary transfer rollers 7Y, 7M, 7C, and 7K, intermediate transfer roller 1, and secondary transfer roller 9 serving as ion conductive components. The "replacement timing" indicates the last time at which each "component" was replaced. The "number of printed sheets" indicates the number of sheets printed after the replacement timing, using each "component". In the example shown in FIG. 4, it can be seen that charging roller 4Y was replaced on May 24, 2016, at 12:01, and 300,000 sheets (i.e., 300 k sheets) have been printed after the replacement, using charging roller 4Y.

When CPU 310 receives a printing instruction via operation panel 80 or communication interface 350, CPU 310 counts up the number of printed sheets for each component operating according to the printing instruction, of the components stored in table 372 for the number of printed sheets. As an example, when CPU 310 receives a printing instruction for monochrome printing, CPU 310 counts up the number of printed sheets for each of charging roller 4K, primary transfer roller 7K, intermediate transfer roller 1, and secondary transfer roller 9.

Further, when CPU 310 receives an input of an operation for replacing a component, CPU 310 refers to timer 360, overwrites the replacement timing for the replaced component in table 372 for the number of printed sheets with timing at which CPU 310 has received the input of the operation for replacing the component, and resets the number of printed sheets for the component to "0".

As described above, the life of an ion conductive component can be calculated more accurately by considering the operating time and the non-operating time of the component. The number of printed sheets relates to the operating time. Accordingly, image forming apparatus 200 according to an embodiment can estimate the life of an ion conductive component based on the number of printed sheets per unit time in consideration of the operating time and the non-operating time.

Figure 5:
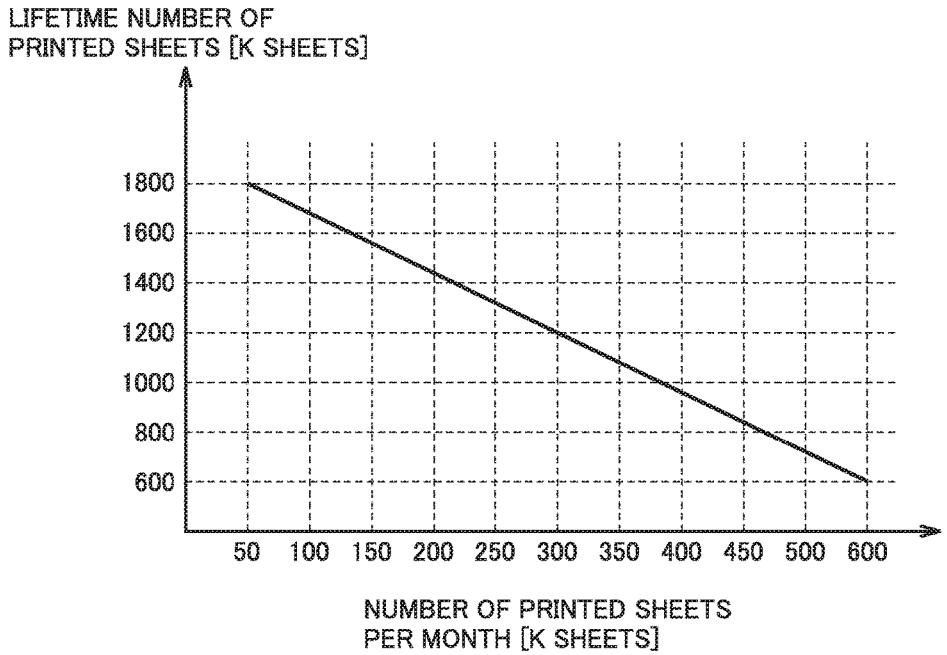
FIG. 5 is a view showing the relation between the life of an ion conductive component and the number of printed sheets per unit time according to an embodiment.

FIG. 5 is a view showing the relation between the life of an ion conductive component and the number of printed sheets per unit time according to an embodiment. In FIG. 5, the axis of abscissas represents the number of printed sheets per month, and the axis of ordinates represents the lifetime number of printed sheets which can be printed using the ion conductive component. In an embodiment, it is assumed that FIG. 5 shows the life of charging roller 4Y.

As shown in FIG. 5, the lifetime number of printed sheets for charging roller 4Y is decreased with an increase in the number of printed sheets per unit time for charging roller 4Y. In an aspect, for each ion conductive component, a relational expression 374 expressing the relation between the number of printed sheets per unit time and the lifetime number of printed sheets as shown in FIG. 5 may be stored in storage device 370.

In an aspect, in estimating the lifetime number of printed sheets for charging roller 4Y, CPU 310 calculates the number of printed sheets per month from the number of printed sheets and the replacement timing for charging roller 4Y which are held in table 372 for the number of printed sheets. Then, CPU 310 can calculate the lifetime number of printed sheets for charging roller 4Y from the calculated number of printed sheets per month and relational expression 374 for charging roller 4Y.

In an aspect, CPU 310 can calculate the number of remaining printable sheets, by subtracting the current number of printed sheets held in table 372 for the number of printed sheets from the calculated lifetime number of printed sheets.

In an aspect, CPU 310 can calculate a remaining time until the life ends, by dividing the number of remaining printable sheets by the number of printed sheets per unit time calculated above.

Figure 6:
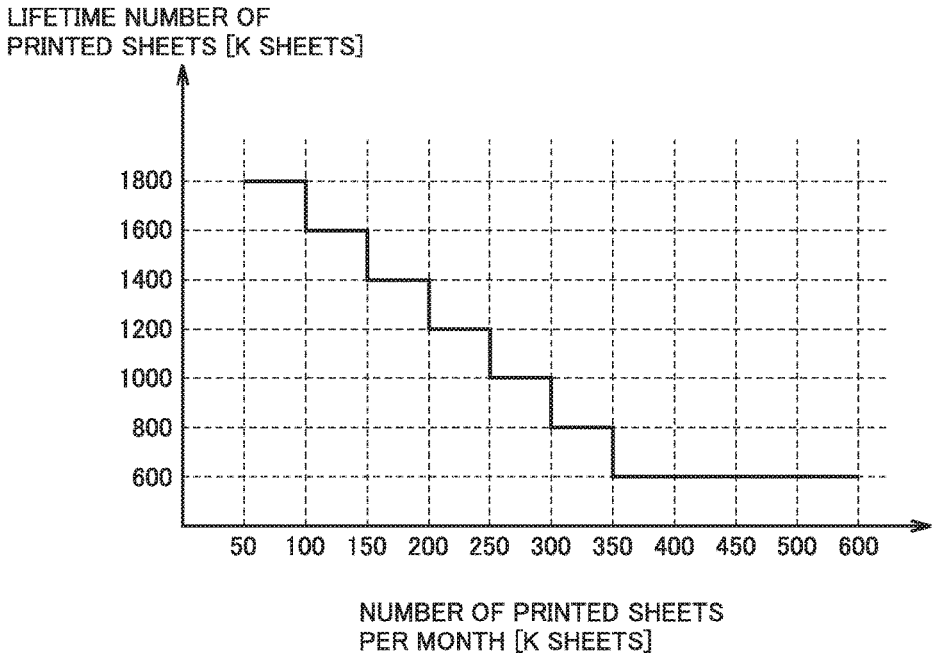
FIG. 6 is a view showing the relation between the life of an ion conductive component and the number of printed sheets per unit time according to an embodiment.
Figure 7:
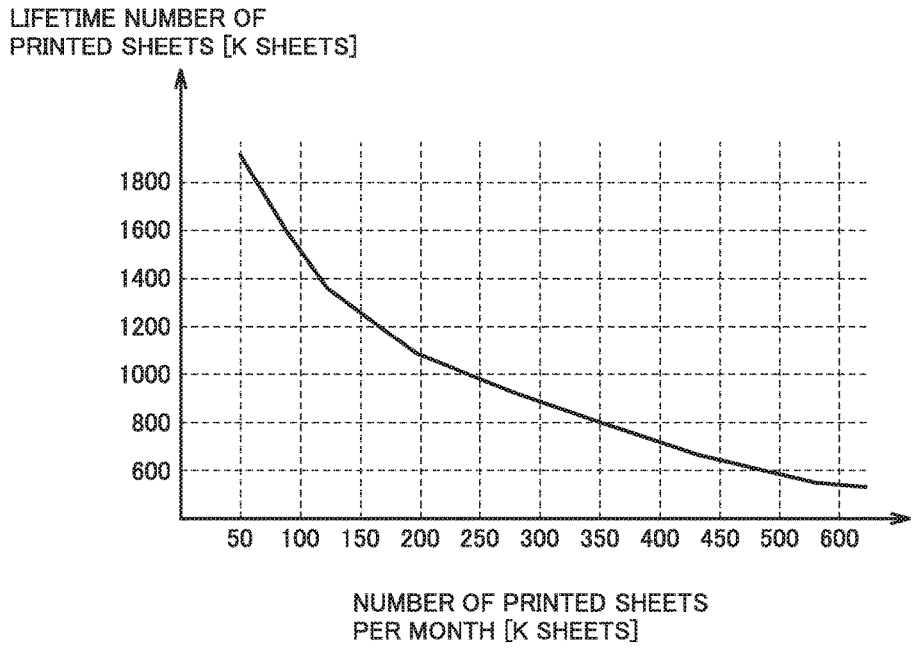
FIG. 7 is a view showing the relation between the life of an ion conductive component and the number of printed sheets per unit time according to an embodiment.

It should be noted that the relation between the number of printed sheets per unit time and the lifetime number of printed sheets expressed by relational expression 374 is not limited to a proportional relation as shown in FIG. 5. Relational expression 374 may be any expression which can uniquely define the lifetime number of printed sheets from the number of printed sheets per unit time. In another aspect, the relation therebetween expressed by relational expression 374 may be a relation in which the lifetime number of printed sheets is uniquely defined when the number of printed sheets per unit time is within a certain range as shown in FIG. 6, or may be a relation indicated by a multi-order curve as shown in FIG. 7.

(Flow of Estimating Life)

Figure 8:
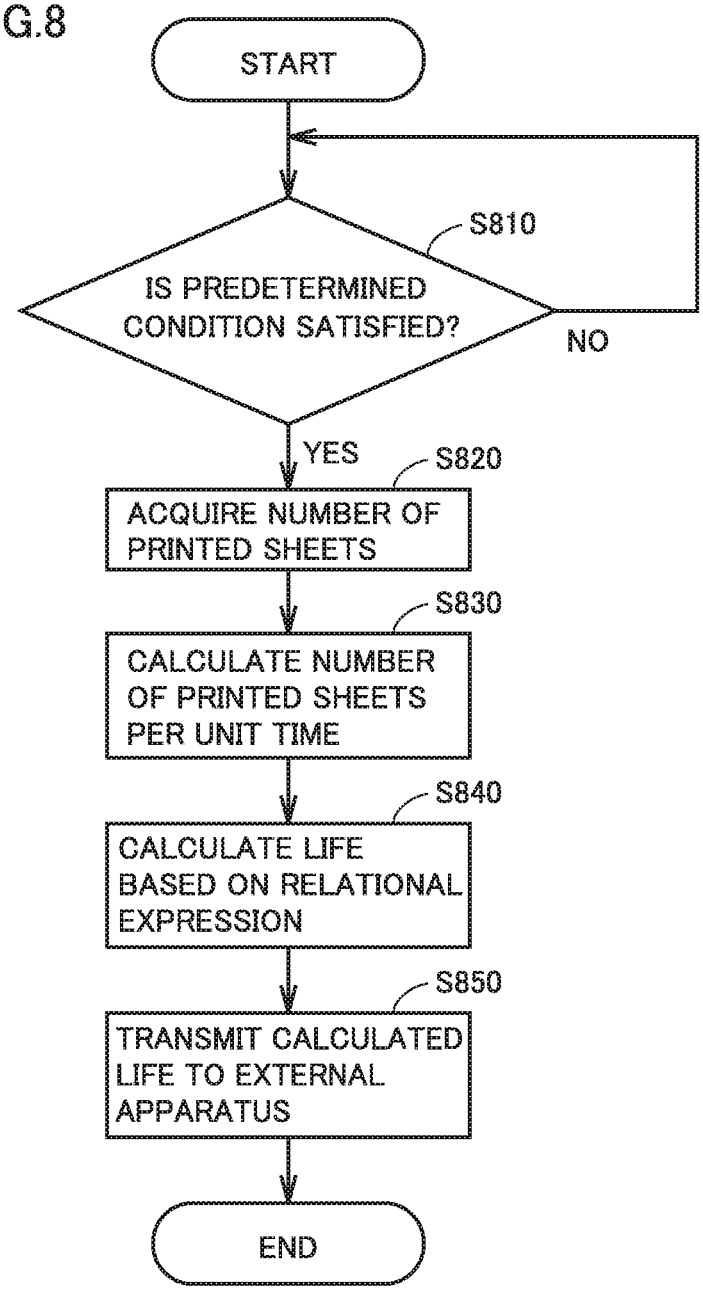
FIG. 8 is a flowchart illustrating a flow of control for estimating the life of an ion conductive component according to an embodiment.

FIG. 8 is a flowchart illustrating a flow of control for estimating the life of an ion conductive component according to an embodiment. The processing shown in FIG. 8 can be implemented by CPU 310 executing a control program stored in ROM 320 or storage device 370. In another aspect, a part or the whole of the processing may be executed by hardware such as a circuit element or the like.

In step S810, CPU 310 determines whether or not a predetermined condition for estimating the life is satisfied for each ion conductive component. In an aspect, when the number of printed sheets held in table 372 for the number of printed sheets reaches a predetermined number of sheets (for example, every 10 k sheets), CPU 310 can determine that the predetermined condition is satisfied. In another aspect, when CPU 310 receives an input of a life estimation instruction via operation panel 80 or communication interface 350, CPU 310 can determine that the predetermined condition is satisfied. In still another aspect, when image forming apparatus 200 is powered on, CPU 310 can determine that the predetermined condition is satisfied.

When CPU 310 determines that the predetermined condition is satisfied (YES in step S810), CPU 310 proceeds the processing to step S820. On the other hand, when CPU 310 determines that the predetermined condition is not satisfied (NO in step S810), CPU 310 returns the processing to step S810, and waits until the condition is satisfied.

In step S820, CPU 310 refers to table 372 for the number of printed sheets stored in storage device 370, and acquires the number of printed sheets for an ion conductive component for which the condition is satisfied in step S810. In step S830, CPU 310 calculates the number of printed sheets per unit time, based on a time period from a time point of the replacement timing held in table 372 for the number of printed sheets to a current time point (i.e., a time point at which the condition is satisfied in step S810), and the acquired number of printed sheets.

In step S840, CPU 310 calculates the life of the ion conductive component for which the condition is satisfied in step S810, based on the calculated number of printed sheets per unit time and relational expression 374 for the ion conductive component.

In step S850, CPU 310 transmits the calculated life to an external apparatus via the communication interface.

According to the above description, since image forming apparatus 200 according to an embodiment calculates the life of an ion conductive component based on the number of printed sheets per unit time in consideration of the operating time and the non-operating time of the component, image forming apparatus 200 can estimate the life with accuracy. Since the gap between the estimated life and the actual life is reduced, the ion conductive component can be used for a longer time period. Thereby, the economic burden on the user due to component replacement can be reduced.

Further, image forming apparatus 200 according to an embodiment can transmit the estimated life (the lifetime number of printed sheets, a remaining usable time period, the number of remaining usable sheets, or the like) to a server of a management company which provides a maintenance service for image forming apparatuses 200, via the communication interface. Thereby, a serviceperson who performs a maintenance service can efficiently visit customers and replace components. In an aspect, the serviceperson can check the image forming apparatuses in order, from an image forming apparatus which is closest to the end of its life. In an aspect, the serviceperson can check an image forming apparatus determined to be far from the end of its life, only through a phone conversation with a user. In addition, the management company which provides a maintenance service can perform inventory management (order management) of replacement components and the like, based on life data transmitted from a plurality of image forming apparatuses.

Further, image forming apparatus 200 according to an embodiment can transmit the estimated life, data held in table 372 for the number of printed sheets, environmental data acquired by a temperature/humidity sensor not shown, positional information, and the like, to a manufacturing company of the image forming apparatus. Thereby, the manufacturing company of the image forming apparatuses can calculate an environment where each image forming apparatus is installed, how the life transitions in each environment, and the like, for each region or for each season, based on the data transmitted from a plurality of image forming apparatuses. Based on the calculated data, the manufacturing company of the image forming apparatuses can appropriately modify relational expression 374 to be more accurate, and provide feedback for development of succeeding image forming apparatuses.

It should be noted that, although image forming apparatus 200 in the above example is configured to transmit the calculated life to an external apparatus (in step S850), image forming apparatus 200 in another aspect may be configured to display the calculated life on operation panel 80. The life includes at least one of the number of remaining printable sheets, the remaining usable time period, and the lifetime number of printed sheets.

Further, although image forming apparatus 200 in the above example is configured to calculate the life using the number of printed sheets per unit time, the parameter per unit time is not limited to the number of printed sheets. Image forming apparatus 200 according to an embodiment can calculate the life using an index value related to energization of an ion conductive component per unit time. The index value related to energization may include not only the number of printed sheets, but also a running distance of an ion conductive component, a running time of the component, a voltage application time for which a voltage is applied to the component, a voltage application distance (running distance) for which the voltage is applied to the component, and the like. Further, image forming apparatus 200 according to an embodiment can consider the life of a component in consideration of the magnitude of a voltage applied to the component. More specifically, image forming apparatus 200 can estimate that a component has a shorter life as a higher voltage is applied to the component.

Figure 9A:
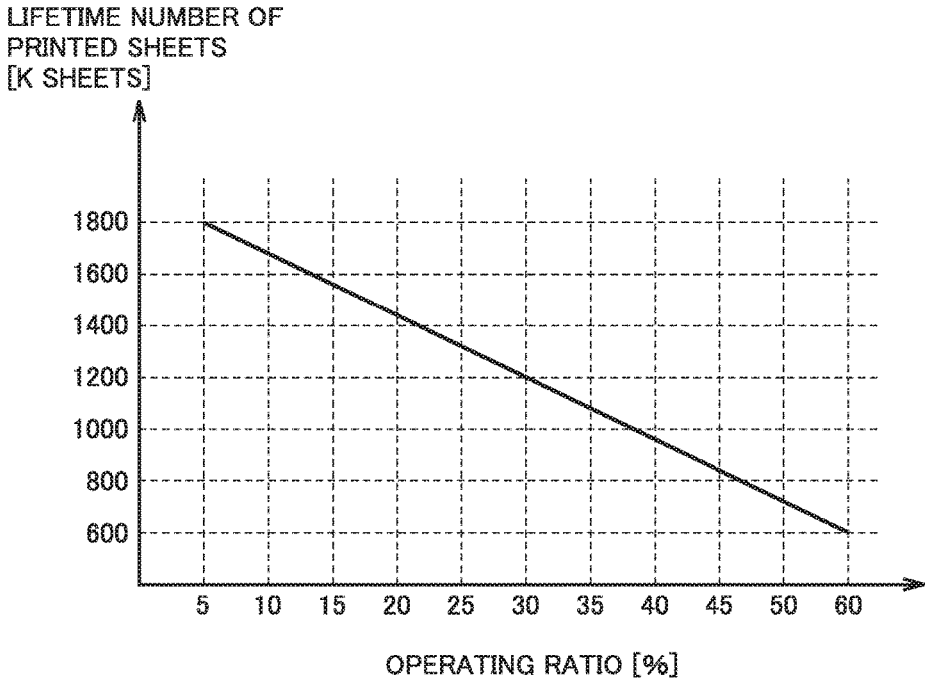
FIG. 9A is a view showing the relation between the life of an ion conductive component and the operating ratio of the ion conductive component.
Figure 9B:
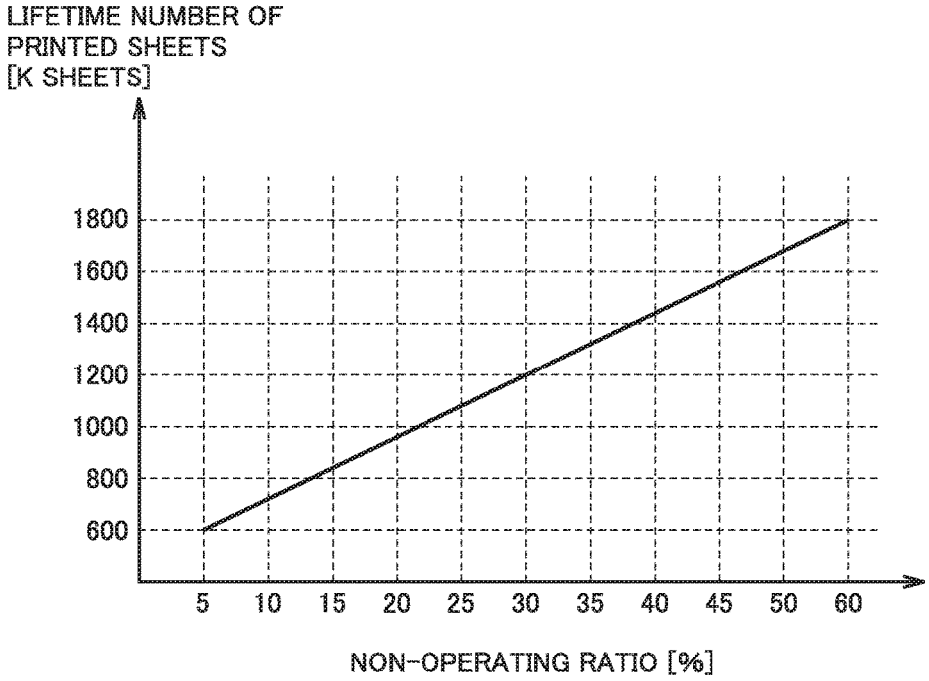
FIG. 9B is a view showing the relation between the life of an ion conductive component and the non-operating ratio of the ion conductive component.

FIGS. 9A and 9B are views each showing the relation between the life of an ion conductive component and an index value related to energization per unit time, according to an embodiment. FIG. 9A is a view showing the relation between the life of an ion conductive component and the operating ratio of the ion conductive component. FIG. 9B is a view showing the relation between the life of an ion conductive component and the non-operating ratio of the ion conductive component. The axis of abscissas in FIG. 9A represents the operating ratio of the ion conductive component when the running time of the ion conductive component or the voltage application time for the ion conductive component is used as an index value related to energization. The operating ratio indicates the ratio of the running time of the ion conductive component or the voltage application time for the ion conductive component, to a time from the time point of the replacement timing held in table 372 for the number of printed sheets to the time point at which the life is estimated. As shown in FIG. 9A, the lifetime number of printed sheets is decreased with an increase in the operating ratio.

The axis of abscissas in FIG. 9B represents the non-operating ratio of the ion conductive component when the running time of the ion conductive component or the voltage application time for the ion conductive component is used as an index value related to energization. The non-operating ratio indicates the ratio of a time for which the ion conductive component is not running or a time for which the voltage is not applied to the ion conductive component, to the time from the time point of the replacement timing held in table 372 for the number of printed sheets to the time point at which the life is estimated. As shown in FIG. 9B, the lifetime number of printed sheets is increased with an increase in the non-operating ratio.

Image forming apparatus 200 according to an embodiment may be configured to hold relational expression 374 expressing the relation between the operating ratio or the non-operating ratio and the lifetime number of printed sheets as shown in FIG. 9A or FIG. 9B, as relational expression 374, and to estimate the life of the ion conductive component from the operating ratio or the non-operating ratio at the time point at which the life is estimated, and relational expression 374.

Second Embodiment

In the above example, image forming apparatus 200 according to an embodiment is configured to estimate the life of an ion conductive component based on the number of printed sheets per unit time. As described above, in an aspect, the life of an ion conductive component is a time period that elapses until the resistance value of the component reaches a predetermined value. This resistance value may be influenced by an environment where image forming apparatus 200 is used, an environment where image forming apparatus 200 is installed (temperature and humidity), and a manufacturing error of the ion conductive component (such as a blending ratio of plural types of ion conductive materials, for example). Accordingly, when the life is estimated only based on the number of printed sheets per unit time, a slight difference may arise between the actual life and the estimated life. Therefore, a configuration and control of an image forming apparatus which can correct this difference will be described below.

(Configuration of Image Forming Apparatus 1000)

Figure 10:
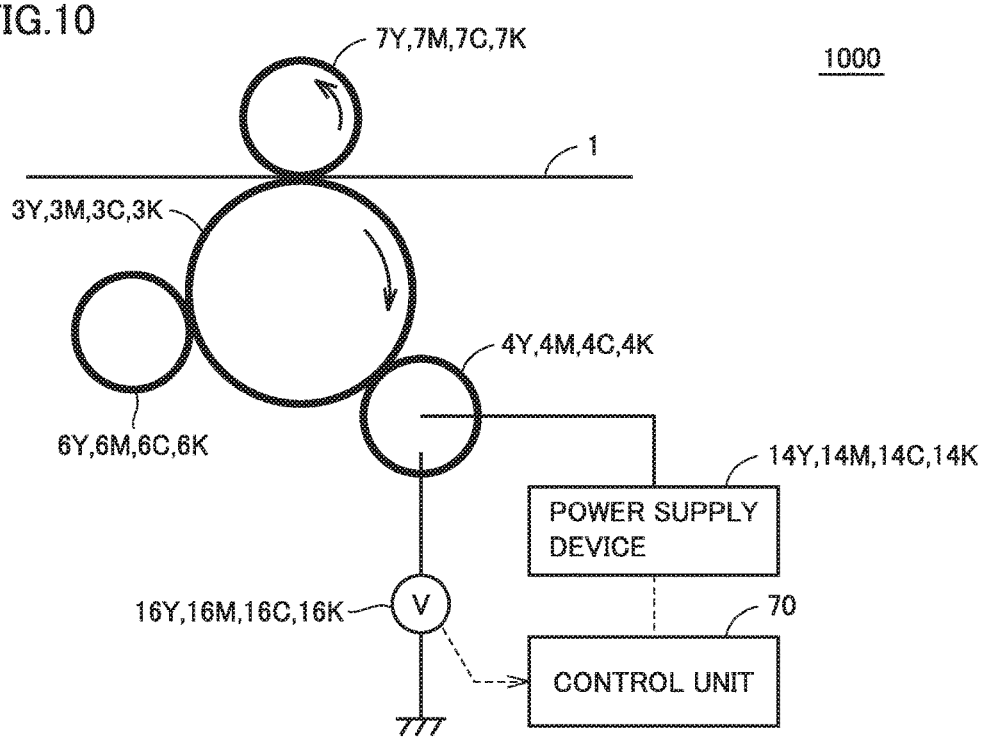
FIG. 10 is a view illustrating a portion of a configuration of an image forming apparatus 1000 according to an embodiment.

FIG. 10 is a view illustrating a portion of a configuration of an image forming apparatus 1000 according to an embodiment. Since the basic configuration of image forming apparatus 1000 is substantially the same as the basic configuration of image forming apparatus 200 described above, only a difference therebetween will be described.

Referring to FIG. 10, power supply devices 14Y, 14M, 14C, and 14K and voltmeters 16Y, 16M, 16C, and 16K are electrically connected to charging rollers 4Y, 4M, 4C, and 4K, respectively, of image forming apparatus 1000. Power supply devices 14Y, 14M, 14C, and 14K and voltmeters 16Y, 16M, 16C, and 16K are electrically connected to control unit 70.

Control unit 70 controls power supply devices 14Y, 14M, 14C, and 14K to apply a constant current to charging rollers 4Y, 4M, 4C, and 4K, and acquires sensor values of voltmeters 16Y, 16M, 16C, and 16K on that occasion. Thereby, control unit 70 can indirectly acquire resistance values of charging rollers 4Y, 4M, 4C, and 4K.

It should be noted that, in another aspect, image forming apparatus 1000 may be any image forming apparatus configured to apply a constant voltage to charging rollers 4Y, 4M, 4C, and 4K and to acquire current values flowing on that occasion, or configured to be able to acquire electrical characteristics of other ion conductive components.

In still another aspect, power supply devices 14Y, 14M, 14C, and 14K may be one common power supply device. Further, these power supply devices may be the same as or different from a power supply device which applies a charging bias for charging the photoconductors.

Although the above description describes the configuration for acquiring electrical characteristics of the charging rollers serving as ion conductive components, image forming apparatus 1000 also has a configuration for acquiring electrical characteristics of other ion conductive components (such as primary transfer rollers 7Y, 7M, 7C, and 7K, intermediate transfer roller 1, and secondary transfer roller 9, for example).

(Method for Correcting Estimated Life)

Figure 11:
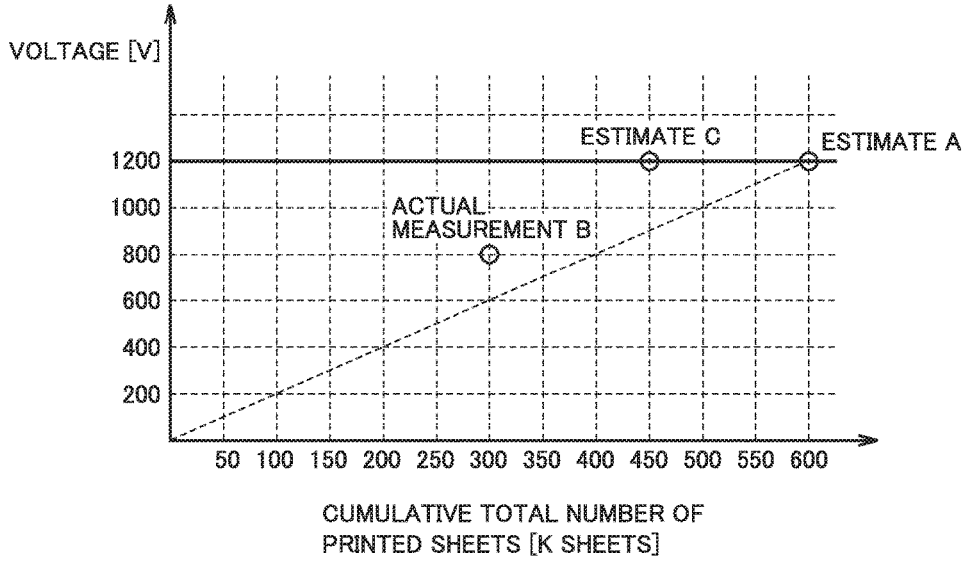
FIG. 11 is a view illustrating life correction control of image forming apparatus 1000 according to an embodiment.

FIG. 11 is a view illustrating life correction control of image forming apparatus 1000 according to an embodiment. As an example, it is assumed that FIG. 11 relates to correction of the life of charging roller 4Y. In FIG. 11, the axis of abscissas represents a cumulative total number of printed sheets printed using charging roller 4Y after replacement, and the axis of ordinates represents a voltage value acquired by voltmeter 16Y when a constant current (for example, 1 A) is passed.

In an aspect, in a case where the voltage value acquired when the constant current of 1 A is passed to charging roller 4Y reaches 1200 V, CPU 310 of image forming apparatus 1000 can determine that charging roller 4Y has reached the end of its life.

In an aspect, it is assumed that, at the timing when the cumulative total number of printed sheets reaches 300 k sheets, image forming apparatus 1000 determines that the lifetime number of printed sheets for charging roller 4Y is 600 k sheets (estimate A), using the method described above. In other words, CPU 310 determines that half of the life of charging roller 4Y has elapsed at present. In this case, the voltage value of charging roller 4Y at present acquired when the constant current of 1 A is passed may be 600 V, which is half of the voltage value of 1200 V determined as the life.

In contrast, it is assumed that, at the timing when the cumulative total number of printed sheets reaches 300 k sheets, the voltage value acquired by voltmeter 16Y when the constant current of 1 A is passed from power supply device 14Y to charging roller 4Y is 800 V (actual measurement B). In this case, CPU 310 can estimate that the lifetime number of printed sheets to be printed until the voltage value reaches 1200 V is 450 k (=1200 V/800 V×300 k sheets) (estimate C).

Figure 12:
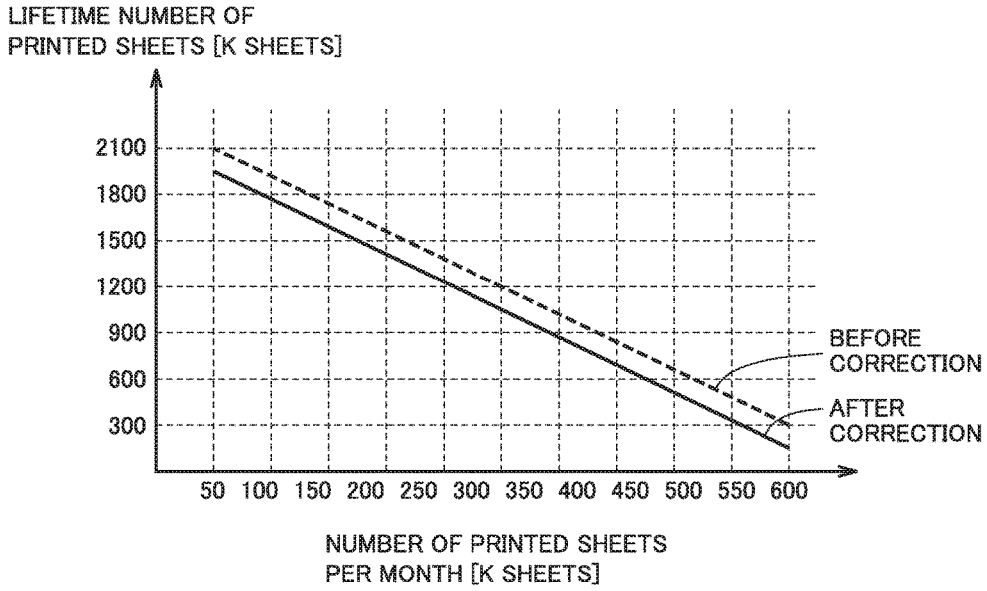
FIG. 12 is a view illustrating life correction control of image forming apparatus 1000 according to an embodiment.

According to the above description, the lifetime number of printed sheets estimated based on the number of printed sheets (or an index value related to energization) per unit time is greater than the lifetime number of printed sheets estimated based on an electrical characteristic value, by 150 k sheets. Accordingly, in an aspect, CPU 310 can correct the lifetime number of printed sheets with respect to the number of printed sheets per unit time expressed by relational expression 374, to be decreased by 150 k sheets as shown in FIG. 12. As an example, a case where relational expression 374 is expressed in the form of $y=ax+b$ as in FIG. 12 will be described. "y" indicates the lifetime number of printed sheets, "a" indicates the amount of change of the lifetime number of printed sheets with respect to the amount of change of the number of printed sheets per unit time (that is, a gradient), "x" indicates the number of printed sheets per unit time, and "b" indicates the value of the lifetime number of printed sheets which may be set if the number of printed sheets per unit time is 0. In this case, CPU 310 can correct the value of "b" to be decreased by 150 k.

As an example, when the predetermined condition described in step S810 in FIG. 8 is satisfied (that is, when the life of an ion conductive component is estimated), CPU 310 of image forming apparatus 1000 according to an embodiment can acquire an electrical characteristic of the ion conductive component, and correct the estimated life based on the electrical characteristic.

In another aspect, CPU 310 can adopt another correction method. As an example, CPU 310 can correct the value of "a" without changing the value of "b" such that the relational expression passes through the lifetime number of printed sheets (y) estimated based on the electrical characteristic value with respect to the number of printed sheets (x) per unit time at present.

Further, in the above example, the lifetime number of printed sheets estimated based on the electrical characteristic value is 25% lower than the lifetime number of printed sheets estimated based on the number of printed sheets (or an index value related to energization) per unit time. Accordingly, in still another aspect, CPU 310 can correct the value of "a" such that the relational expression passes through the lifetime number of printed sheets (y) estimated based on the electrical characteristic value with respect to the number of printed sheets (x) per unit time at present, and the lifetime number of printed sheets is totally decreased by 25%. It should be noted that the concept of the correction method described above is also applicable to a case where relational expression 374 is a multi-order function.

According to the above description, image forming apparatus 1000 according to an embodiment can estimate the life of an ion conductive component more accurately than image forming apparatus 200 described above.

Third Embodiment

The resistance value of an ion conductive component may be influenced by the temperature and humidity when the component is operating (i.e., when a voltage is applied to the component). More specifically, the increasing rate of the resistance value of the ion conductive component is higher with a decrease in temperature when the component is operating (i.e., when a voltage is applied to the component). Further, the increasing rate of the resistance value of the ion conductive component is higher with a decrease in humidity when the component is operating. Accordingly, an image forming apparatus according to an embodiment estimates the life of an ion conductive component in consideration of temperature and humidity.

Figure 13:
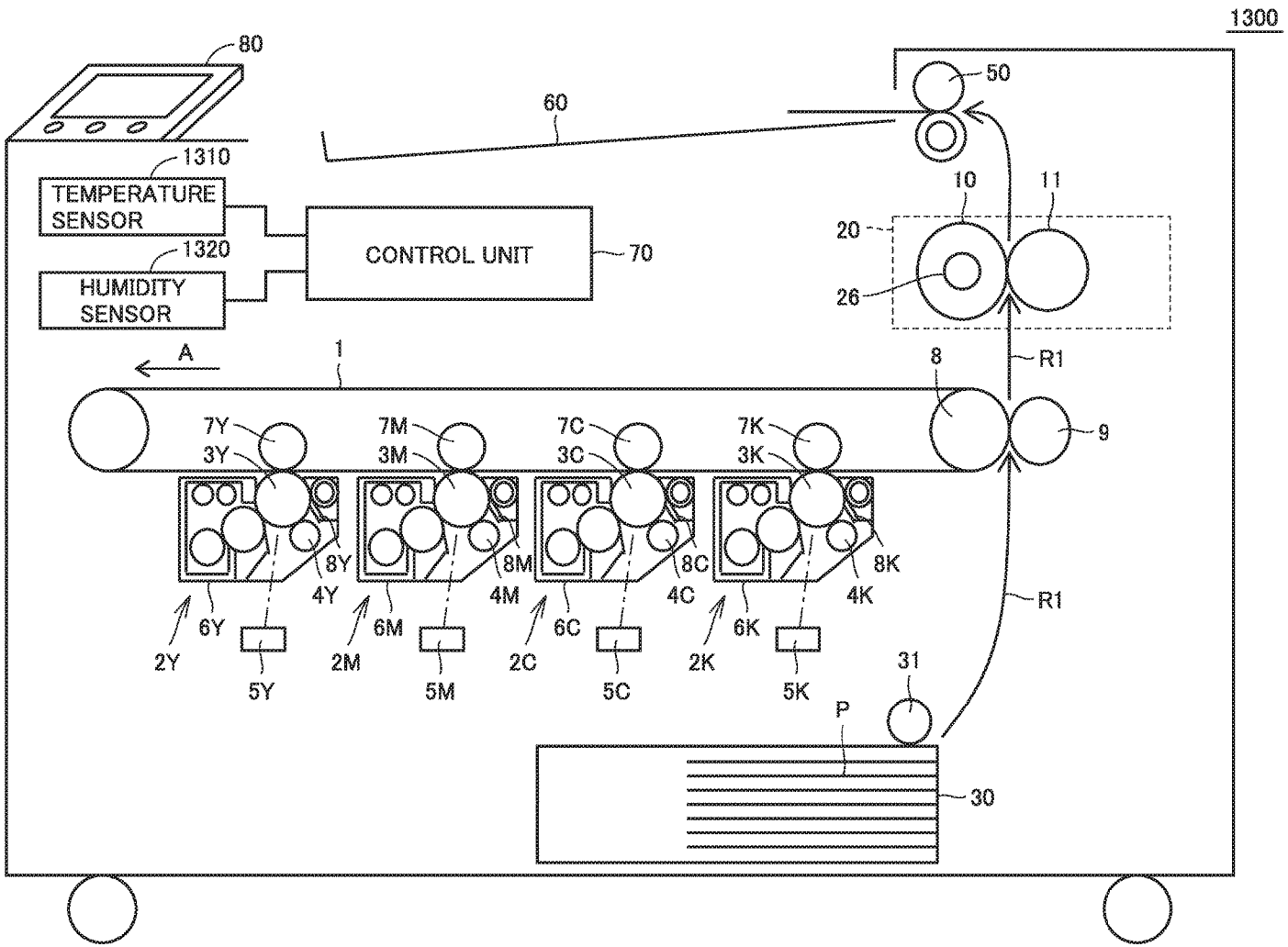
FIG. 13 is a view illustrating a configuration of an image forming apparatus 1300 according to an embodiment.

FIG. 13 is a view illustrating a configuration of an image forming apparatus 1300 according to an embodiment. It should be noted that, since parts designated by the same reference numerals as those in FIG. 2 are identical to the parts in FIG. 2, the description of the parts will not be repeated.

Referring to FIG. 13, image forming apparatus 1300 is different from image forming apparatus 200 shown in FIG. 2 in that image forming apparatus 1300 has a temperature sensor 1310 and a humidity sensor 1320. Control unit 70 is electrically connected to each of temperature sensor 1310 and humidity sensor 1320.

Figure 14:
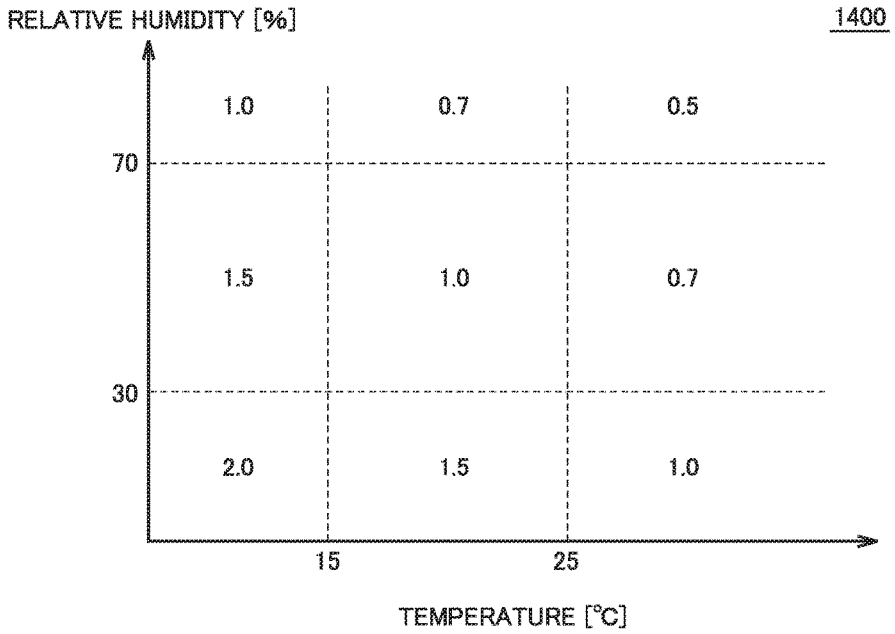
FIG. 14 is a view illustrating a temperature/humidity table 1400 according to an embodiment.

FIG. 14 is a view illustrating a temperature/humidity table 1400 according to an embodiment. Temperature/humidity table 1400 can be stored in storage device 370. It should be noted that, although temperature/humidity table 1400 is shown as a two-dimensional table in FIG. 14 to provide a clear explanation, coefficients are actually held in association with a temperature range and a humidity range. More specifically, the coefficients are set to be higher with a decrease in temperature or a decrease in humidity.

When printing is performed. CPU 310 of image forming apparatus 1300 according to an embodiment measures temperature and humidity (relative humidity), using temperature sensor 1310 and humidity sensor 1320. CPU 310 refers to temperature/humidity table 1400, and specifies a coefficient corresponding to the measured temperature and humidity. When CPU 310 counts up the number of printed sheets in table 372 for the number of printed sheets, CPU 310 counts up the number of printed sheets by a value obtained by multiplying the number of printed sheets by the specified coefficient.

As described above, the increasing rate of the resistance value of an ion conductive component is higher with a decrease in temperature or a decrease in humidity. Accordingly, the coefficients held in temperature/humidity table 1400 are higher with a decrease in temperature or a decrease in humidity.

As an example, in a case where CPU 310 receives a printing instruction for monochrome printing of 10 sheets when the temperature is 12° C. and the humidity is 50%, CPU 310 specifies that the coefficient is "1.5", from temperature/humidity table 1400. Then, CPU 310 counts up the number of printed sheets for each of charging roller 4K, primary transfer roller 7K, intermediate transfer roller 1, and secondary transfer roller 9 held in table 372 for the number of printed sheets, by "15".

According to the above description, since image forming apparatus 1300 according to an embodiment calculates the life of an ion conductive component in consideration of temperature and humidity, image forming apparatus 1300 can estimate the life more accurately.

It should be noted that, although image forming apparatus 1300 in the above example is configured to estimate the life of an ion conductive component using temperature and humidity, image forming apparatus 1300 may be configured to estimate the life using at least one of temperature and humidity.

Fourth Embodiment (Transport Speed)

The increasing rate of the resistance value of an ion conductive component is higher with an increase in a voltage applied to the component during printing. Accordingly, an image forming apparatus according to an embodiment estimates the life of an ion conductive component in consideration of the magnitude of an applied voltage. It should be noted that the basic configuration of the image forming apparatus according to this embodiment is the same as that of image forming apparatus 200 illustrated in FIG. 2.

FIG. 15 is a view illustrating a speed table 1500 according to an embodiment. Generally, the voltage applied to an ion conductive component is increased with an increase in the transport speed of sheets in the transport path (i.e., system speed).

Accordingly, image forming apparatus 200 according to an embodiment stores speed table 1500 in storage device 370. Speed table 1500 stores each range of a transport speed y of sheets P in transport path R1 and a coefficient in a manner in which they are associated with each other. More specifically, the coefficients are set to be higher with an increase in transport speed v.

When CPU 310 of image forming apparatus 200 according to an embodiment counts up the number of printed sheets in table 372 for the number of printed sheets, CPU 310 counts up the number of printed sheets by a value obtained by multiplying the number of printed sheets by a coefficient corresponding to transport speed v during printing.

As an example, in a case where CPU 310 receives a printing instruction for monochrome printing of 10 sheets when transport speed v is 265 mm/sec, CPU 310 specifies that the coefficient is "0.5", from speed table 1500. Then, CPU 310 counts up the number of printed sheets for each of charging roller 4K, primary transfer roller 7K, intermediate transfer roller 1, and secondary transfer roller 9 held in table 372 for the number of printed sheets, by "5".

According to the above description, since image forming apparatus 200 in which the voltage applied to an ion conductive component is increased with an increase in transport speed v calculates the life of the ion conductive component based on transport speed v, in other words, in consideration of the applied voltage, image forming apparatus 200 can estimate the life more accurately.

It should be noted that, although speed table 1500 in the above example holds each range of transport speed v and a coefficient in a manner in which they are associated with each other, the table may have another configuration. In an aspect, image forming apparatus 200 may be configured to be able to switch a plurality of transport speeds v. In this case, speed table 1500 may hold each specific transport speed v, instead of each range of transport speed v, and a coefficient in a manner in which they are associated with each other.

(Type of Sheets)

Generally, as sheets to be printed have a greater basis weight, the voltage applied to secondary transfer roller 9 in contact with the sheets is increased. Accordingly, image forming apparatus 200 according to an embodiment counts up the number of printed sheets corresponding to secondary transfer roller 9 in table 372 for the number of printed sheets, in accordance with the type of sheets.

FIG. 16 is a view illustrating a sheet type table 1600 according to an embodiment. Sheet type table 1600 holds each type of sheets and a coefficient in a manner in which they are associated with each other. More specifically, the coefficients are set to be higher with an increase in basis weight.

When CPU 310 of image forming apparatus 200 according to an embodiment counts up the number of printed sheets for secondary transfer roller 9, CPU 310 counts up the number of printed sheets by a value obtained by multiplying the number of printed sheets by a coefficient corresponding to the type of sheets.

As an example, in a case where CPU 310 receives a printing instruction for monochrome printing of 10 sheets when the type of sheets is set by a user to "thick paper", CPU 310 specifies that the coefficient is "2.0", from sheet type table 1600. Then, CPU 310 counts up the number of printed sheets for secondary transfer roller 9 held in table 372 for the number of printed sheets, by "20".

According to the above description, since image forming apparatus 200 in which the applied voltage is set in accordance with the type of sheets calculates the life of the secondary transfer roller based on the type of sheets, in other words, in consideration of the applied voltage, image forming apparatus 200 can estimate the life more accurately.

(Double-Sided Printing)

Generally, when a sheet which has once passed through secondary transfer roller 9 passes through the same component again during double-sided printing, the voltage applied to secondary transfer roller 9 is higher than that applied during the first passage of the sheet. Accordingly, image forming apparatus 200 according to an embodiment counts up the number of printed sheets corresponding to secondary transfer roller 9 in table 372 for the number of printed sheets, in accordance with the type of printing (single-sided printing or double-sided printing).

FIG. 17 is a view illustrating a printing type table 1700 according to an embodiment. Printing type table 1700 holds a coefficient for single-sided printing and a coefficient for double-sided printing. The coefficient for double-sided printing is higher than the coefficient for single-sided printing.

When CPU 310 of image forming apparatus 200 according to an embodiment counts up the number of printed sheets corresponding to secondary transfer roller 9 in table 372 for the number of printed sheets, CPU 310 counts up the number of printed sheets by a value obtained by multiplying the number of printed sheets by the coefficient corresponding to single-sided printing or double-sided printing.

As an example, in a case where CPU 310 receives a printing instruction for double-sided monochrome printing of 10 sheets (the number of documents: 5 sheets), CPU 310 specifies that the coefficient is "1.5", from printing type table 1700. Then, CPU 310 counts up the number of printed sheets for secondary transfer roller 9 held in table 372 for the number of printed sheets, by "15".

It should be noted that, in another aspect, CPU 310 of image forming apparatus 200 may be configured to count up the number of printed sheets, only for the second side of double-sided printing, based on the coefficient corresponding to double-sided printing. In the case of this configuration, CPU 310 in the above example counts up the number of printed sheets corresponding to secondary transfer roller 9 in table 372 for the number of printed sheets, by "7.5" (i.e., 5 sheets are calculated as single-sided printing, and 5 sheets are calculated as double-sided printing).

According to the above description, since image forming apparatus 200 in which the voltage applied to the secondary transfer roller is increased during double-sided printing calculates the life of the secondary transfer roller based on the type of printing, in other words, in consideration of the applied voltage, image forming apparatus 200 can estimate the life more accurately.

Fifth Embodiment

Each ion conductive component is formed by mixing appropriate ion conductive materials (such as hydrin rubber, acrylonitrile-butadiene rubber, and epichlorohydrine rubber) at an appropriate blending ratio, depending on the required characteristic. Accordingly, the increasing rate of the resistance value per unit number of sheets differs, depending on the type of the ion conductive component. Thus, an image forming apparatus according to an embodiment estimates the life of an ion conductive component in accordance with the type of the ion conductive component. It should be noted that the basic configuration of the image forming apparatus according to this embodiment is the same as that of image forming apparatus 200 illustrated in FIG. 2.

Figure 18:
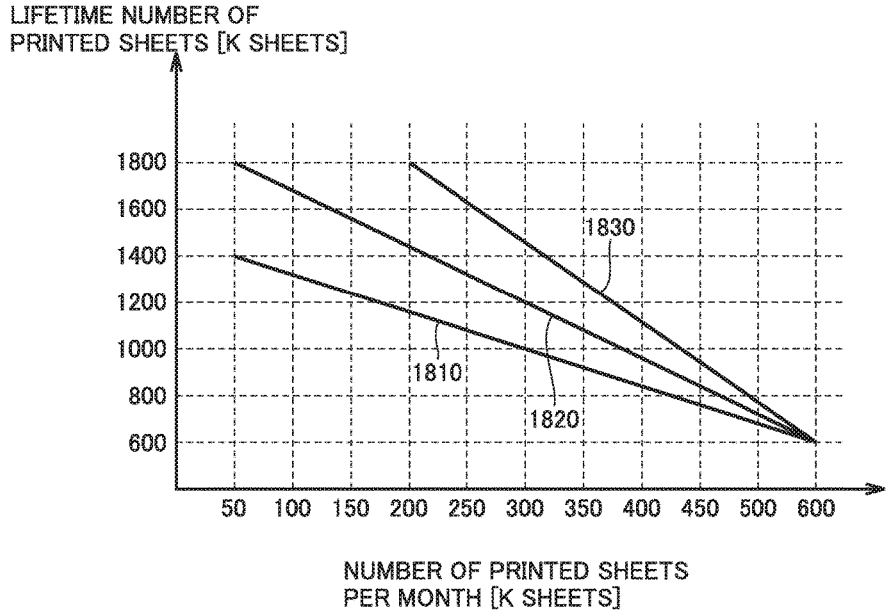
FIG. 18 is a view showing the relation between the life of an ion conductive component and the number of printed sheets per unit time, in accordance with the type of the ion conductive component, according to an embodiment.

FIG. 18 is a view showing the relation between the life of an ion conductive component and the number of printed sheets per unit time, in accordance with the type of the ion conductive component, according to an embodiment. As an example, relational expressions 374 can be set such that an ion conductive component having a higher conductivity has a greater amount of change of the lifetime number of printed sheets with respect to the amount of change of the number of printed sheets per unit time. As an example, a function 1810 can be set as relational expression 374 for secondary transfer roller 9, a function 1820 can be set as relational expression 374 for charging rollers 4Y, 4M, 4C, and 4K, and a function 1830 can be set as relational expression 374 for primary transfer rollers 7Y, 7M, 7C, and 7K.

Further, these ion conductive components (rollers) have different outer perimeters. The longer the outer perimeter is, the less likely non-uniform ion distribution is to occur (i.e., the lower the increasing rate of the resistance value is). Accordingly, in another aspect, relational expression 374 can be set in accordance with the outer peripheral length of a corresponding ion conductive component. More specifically, relational expressions 374 can be set such that an ion conductive component having a shorter outer peripheral length has a greater amount of change of the lifetime number of printed sheets with respect to the amount of change of the number of printed sheets per unit time.

According to the above description, since image forming apparatus 200 according to an embodiment calculates the life of an ion conductive component in consideration of the material forming the ion conductive component and the structure of the component, image forming apparatus 200 can estimate the life more accurately.

It should be noted that, although the above description describes that various functions are implemented by one CPU 310, the present invention is not limited thereto. These various functions can be implemented by a circuit including a semiconductor integrated circuit such as at least one processor, at least one ASIC (Application Specific Integrated Circuit), at least one DSP (Digital Signal Processor), at least one FPGA (Field Programmable Gate Array), and/or a circuit having another calculation function.

These circuits can implement the various functions described above by reading one or more commands from at least one tangible readable medium.

Although such a medium is in the form of any type of memory such as a magnetic medium (for example, a hard disk), an optical medium (for example, a compact disc (CD), a DVD), a volatile memory, and a nonvolatile memory, the medium is not limited to these forms.

The volatile memory may include a DRAM (Dynamic Random Access Memory) and an SRAM (Static Random Access Memory). The nonvolatile memory may include a ROM and an NVRAM. A semiconductor memory may be a portion of a semiconductor circuit together with at least one processor.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an ion conductive component; and a processor for estimating a life of the conductive component, the processor acquiring an index value related to energization of the conductive component, and estimating the life of the conductive component based on the index value per unit time.

2. The image forming apparatus according to claim 1, wherein the conductive component includes at least one of a charging roller for charging an image carrier configured to be able to carry a toner image, an intermediate transfer roller for receiving the toner image formed on the image carrier and transporting the toner image, a primary transfer roller for transferring the toner image formed on the image carrier to the intermediate transfer roller, and a secondary transfer roller for transferring the toner image formed on the intermediate transfer roller to a recording medium.

3. The image forming apparatus according to claim 1, wherein the index value includes at least one of a number of printed sheets, a voltage application time for which a voltage is applied to the conductive component, a voltage application distance for which the voltage is applied to the conductive component, a running time of the conductive component, and a running distance of the conductive component.

4. The image forming apparatus according to claim 3, wherein the processor is configured to estimate that the conductive component has a short life when the index value per unit time is high, and to estimate that the conductive component has a long life when the index value per unit time is low.

5. The image forming apparatus according to claim 1, wherein the index value includes a non-operating time of the conductive component.

6. The image forming apparatus according to claim 5, wherein the processor is configured to estimate that the conductive component has a short life when the index value per unit time is low, and to estimate that the conductive component has a long life when the index value per unit time is high.

7. The image forming apparatus according to claim 1, further comprising a sensor for acquiring an electrical characteristic value of the conductive component, wherein the processor is configured to correct the estimated life of the conductive component based on the electrical characteristic value acquired by the sensor.

8. The image forming apparatus according to claim 1, further comprising a communication interface for communicating with an external apparatus, wherein the processor is configured to transmit the estimated life to the external apparatus via the communication interface.

9. The image forming apparatus according to claim 8, wherein the processor is configured to calculate a time that elapses until the life of the conductive component ends, based on the index value per unit time.

10. The image forming apparatus according to claim 1, further comprising a display, wherein the processor is configured to display the estimated life on the display.

11. The image forming apparatus according to claim 1, wherein the processor is configured to estimate the life of the conductive component based on the index value per unit time and a coefficient corresponding to a material constituting the conductive component.

12. The image forming apparatus according to claim 1, further comprising an environment sensor for acquiring at least one of temperature and humidity, wherein the processor is configured to correct the index value to be counted up in accordance with a value acquired by the environment sensor.

13. The image forming apparatus according to claim 1, wherein the processor is configured to correct the index value based on a magnitude of a voltage applied to the conductive component.

14. The image forming apparatus according to claim 1, wherein the processor is configured to correct the index value to be counted up in accordance with a transport speed of a recording medium.

15. The image forming apparatus according to claim 2, wherein the image forming apparatus is configured to be able to perform double-sided printing on the recording medium, the conductive component is the secondary transfer roller for transferring the toner image formed on the intermediate transfer roller to the recording medium, and the processor is configured to correct the index value to be counted up by the double-sided printing on the recording medium.

16. The image forming apparatus according to claim 2, wherein the conductive component is the secondary transfer roller for transferring the toner image formed on the intermediate transfer roller to the recording medium, and the processor is configured to correct the index value to be counted up in accordance with a type of the recording medium.

17. An image forming apparatus comprising:

an ion conductive component; and a processor for estimating a life of the conductive component, the processor estimating the life of the conductive component based on an operating time and a non-operating time of the conductive component.

18. A method for estimating a life of an ion conductive component, comprising:

acquiring an index value related to energization of the conductive component; and estimating the life of the conductive component based on the index value per unit time.

* * * * *